US006092493A

United States Patent [19]

Leijonberg

[11] Patent Number: 6,092,493

[45] Date of Patent: Jul. 25, 2000

[54] POWER MACHINE VALVE CONTROL

[75] Inventor: Gunnar Leijonberg, Huskvarna, Sweden

[73] Assignee: Gul & Co Development AB, Huskvarna, Sweden

[21] Appl. No.: 09/227,815

[22] Filed: Jan. 11, 1999

Related U.S. Application Data

[63] Continuation of application No. PCT/SE97/00001, Jul. 10, 1997.

[30] Foreign Application Priority Data

Jul. 12, 1996 [SE] Sweden ..... 9602757

[51] Int. Cl.[7] ..... F02B 75/06

[52] U.S. Cl. ..... 123/51 R

[58] Field of Search ..... 123/51 R, 51 A, 123/51 AR, 51 AC, 51 B, 51 BA, 51 BB, 51 BC, 51 BD, 52.2

[56] References Cited

U.S. PATENT DOCUMENTS

| | | | |
|---|---|---|---|
| 1,087,240 | 2/1914 | Kellington . | |
| 1,252,757 | 1/1918 | williams . | |
| 1,481,727 | 1/1924 | Moore . | |
| 1,667,213 | 4/1928 | Marchetti . | |
| 3,563,223 | 2/1971 | Ishida | 123/51 R |

FOREIGN PATENT DOCUMENTS 2552081 6/1977 Germany .

OTHER PUBLICATIONS

Derwent's Abstract, No. 940165211/20, week 9420, Abstract of SU, 1800103—Mar. 7, 1993.

*Primary Examiner*—Marguerite McMahon
*Attorney, Agent, or Firm*—Pillsbury Madison & Sutro LLP

[57] ABSTRACT

The present invention is for the kind of power machines, engines or compressors which have two or more pistons which work against each other preferably with a common combustion or compression chamber in a stationary cylinder and where the power is transmitted to a rotating movement without an intermediate crankshaft. It is an object of the present invention to obtain such power machine having a simple valve control means. One such device has two parallel plane discs, one stationary disc (8) and one relatively thereto rotating disc (13). The stationary disc (8) is mounted to a housing (9) and the disc (8) in turn has one in its centre positioned cylinder (1) with two end walls (2, 3). In the cylinder there are two pistons (4, 5) which are working pistons of a combustion engine and have a common combustion chamber. At the centre of the cylinder bore adjacent to the upper dead centres, UDC, of the pistons and at opposite sides thereof there are two valves (50, 51). The valve shafts at the ends which are turned only from the cylinder contact a controlling curve or surface (56) which is a part of the rotating disc. On the control curve there are raised parts (57, 58) at which the valve are opened when disc rotates.

9 Claims, 4 Drawing Sheets

POWER MACHINE VALVE CONTROL

This application is a continuation of PCT/SE97/00001 filed Jul. 10, 1997.

BACKGROUND OF THE INVENTION

1. Field of the Invention

The present invention relates to valves for power machines, such as engines or compressors that have two or more pistons which work against each other, preferably with a common combustion or compression chamber in a stationary cylinder and where power is transmitted to a rotating movement without an intermediate crankshaft.

2. Description of the Related Art

In presently know engines the valve control means are very complicated. It is an object of the present invention to provide a power machine having a simple valve control means.

In combustion engines the transmission of force from a reciprocating motion to a rotating motion is generally by means of some kind of crankshaft or the like. In certain cases crankshafts are however less suitable and this is especially the case when reciprocating movements of different, often opposite reactions are both transferred into a rotating motion. This concerns especially the kind of power machines, i.e. combustion engines, compressors or pumps, where two pistons at the same time work against each other in a common cylinder bore. In these cases the use of crankshafts brings with it complicated mechanical designs to combine the force from the two pistons into a common rotating motion. The transmission of force between a reciprocating motion and a-rotating motion can instead be by means of a ball bearing mechanism which runs in different tracks and comprises a ball which is surrounded by a ballholder which is attached to a piston-rod for-each ball or to a corresponding device for transmission of the linear movement.

One such device, as disclosed in my co-pending application Ser. No. 09/160,359, has two parallel plane discs, one stationary disc and one relatively thereto rotating disc. In a cylinder which is positioned central relative to the discs, there are two pistons which are working pistons 07 a combustion engine having a common combustion chamber. Firmnly joined to each of the pistons is a piston rod which at its opposite end has a holder means for the ball by which the force from the reciprocating motion is transferred to the rotating disc. The balls also serve as bearing between the stationary disc and the rotating disc. The rotating disc is mounted to a holder which in turn is mounted to an outgoing shaft from which the rotating force is taken for various driving purposes. The balls move both in linear tracks in the fixed disc and in a common elliptic or otherwise closed track in the rotating disc. It is also possible to exchange the balls for other means having a corresponding function for example rolls or pins which roll or slide in the tracks. In other embodiments the tracks may be substituted for by protruding edges contacting for example roller or slide bearings of the sides of the edges.

BRIEF SUMMARY OF THE INVENTION

The present invention represents an improvement to the power device described in my co-pending application by the provision of valves arranged between the upper dead centers of the pistons. Movements of the valves are controlled by ends of the valves contacting curved cam surfaces of the rotating disc.

BRIEF DESCRIPTION OF THE DRAWINGS

The invention will below be described more in detail with reference to the embodiment which is shown in the included figures.

DETAILED DESCRIPTION OF THE PREFERRED EMBODIMENT

Figure 1:
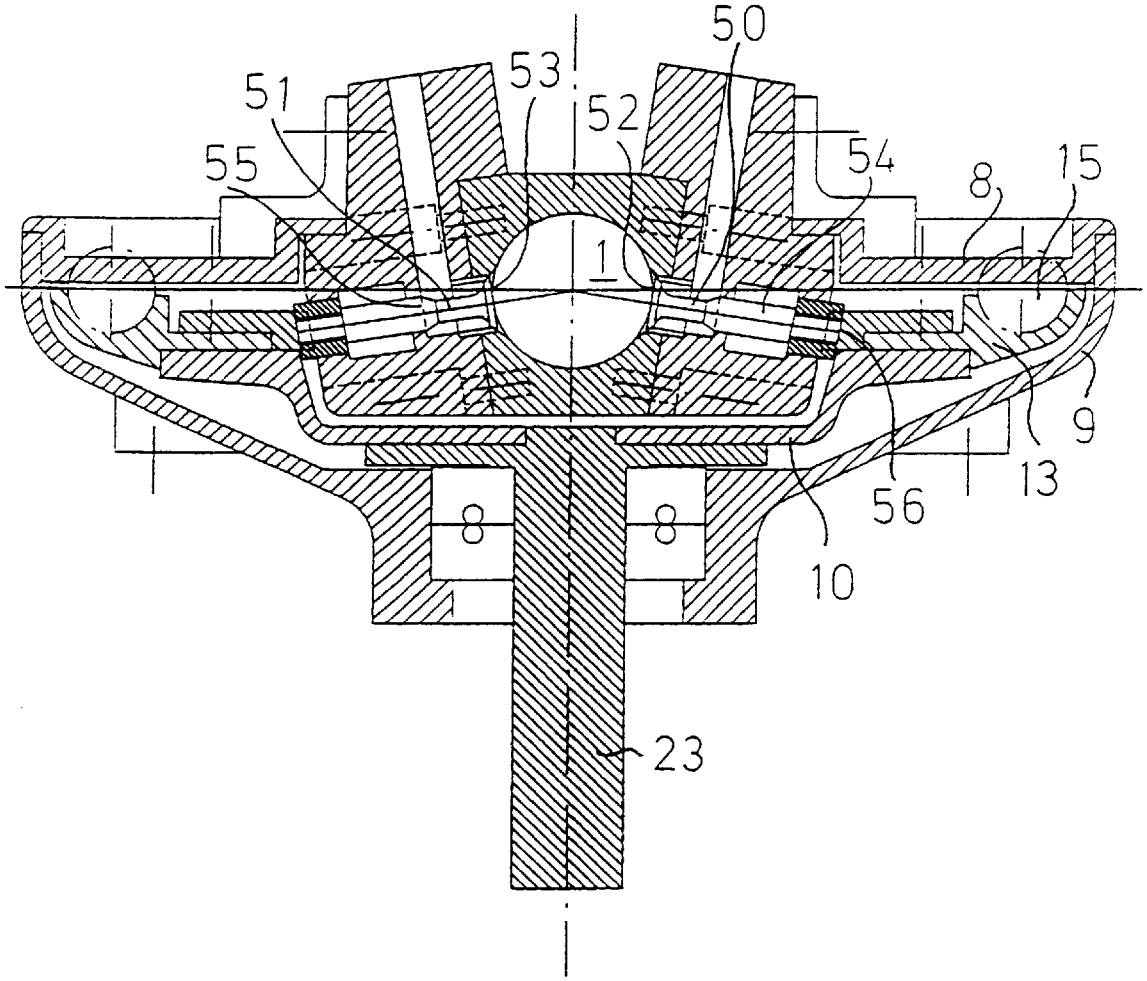
FIG. 1 is a cross-section at right angle to the axial direction of the cylinder of a combustion engine according to the invention.
Figure 2:
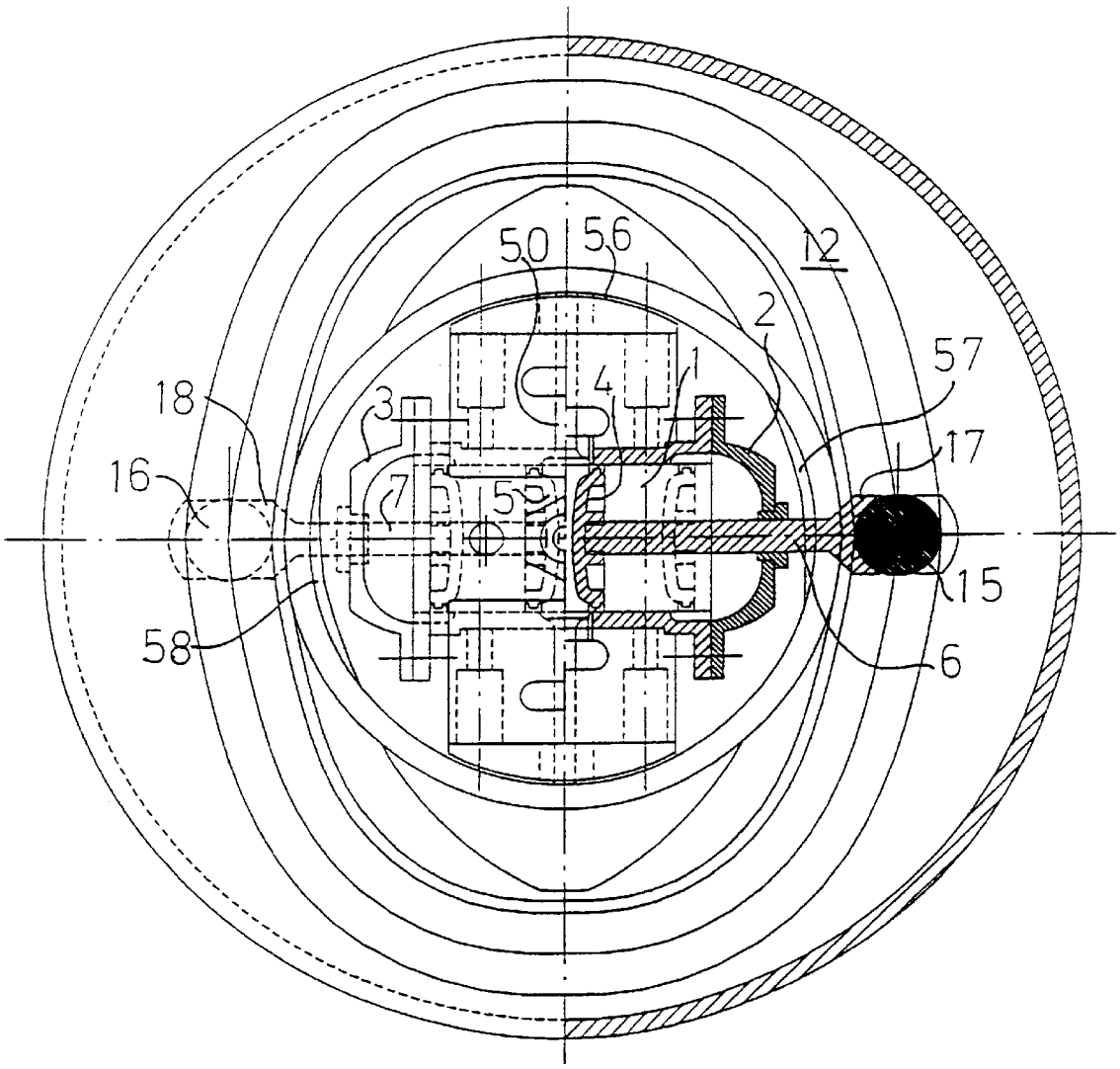
FIG. 2 shows the engine of FIG. 1 in cross-section in a plane which is essentially parallel to the plane of rotation.
Figure 3:
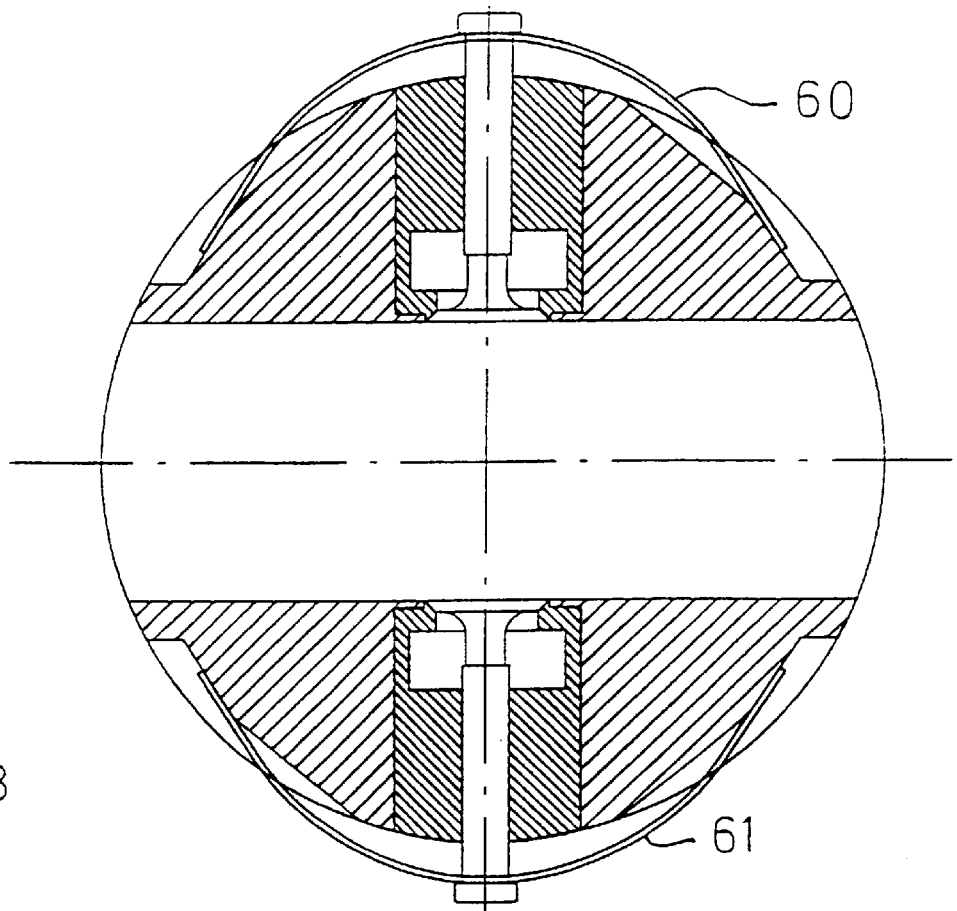
FIGS. 3–6 show two alternative embodiments having valve springs.
Figure 4:
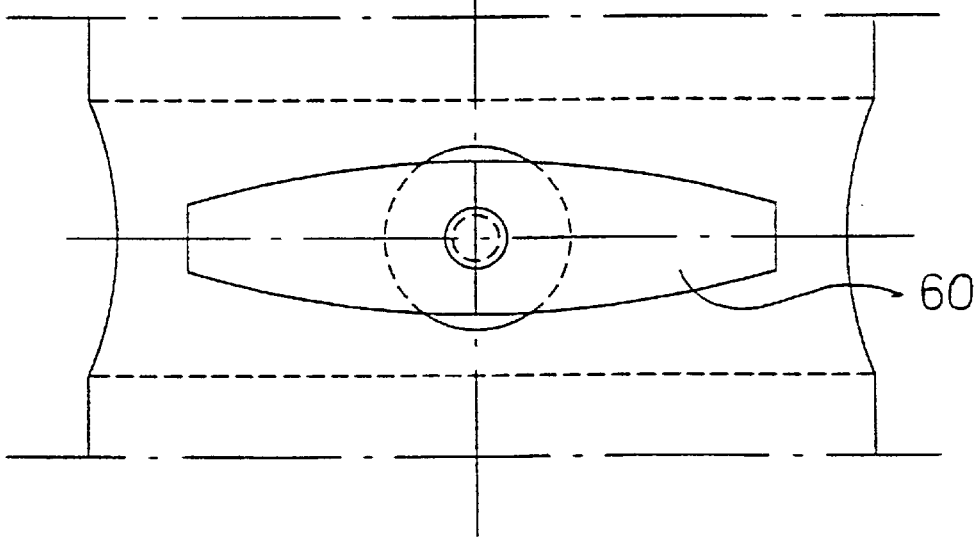

The device shown in FIGS. 1 and 2 has two parallel plane discs, a stationary or fixed disc 8 and a rotating disc 13. The stationary disc 8 is mounted to a housing 9, and a cylinder 1 with two end walls 2, 3 is positioned at the center of disc 8. In the cylinder there are two pistons 4, 5 which are working pistons of a combustion engine and have a common combustion chamber.

Firmly joined to each of the pistons 4, 5 is a piston rod 6, 7 respectively which in its opposite end has a holder means 17, 18 for the ball 15, 16 through which the force from the reciprocating motion is transferred to the rotating disc 13. The balls 15, 16 also serve as bearing between the stationary disc 8 and the rotating disc 13. The rotating disc 13 is mounted to a holder 10 which in turn is mounted to an outgoing shaft 23 from which the rotating force is taken to be used for various driving purposes. In a preferred embodiment of the invention, the centre axis of the cylinder bore coincides with the line of movement of the balls.

The balls 15, 16 are moving both in linear tracks 11, 24 in the fixed disc and in a common elliptic track 12 in the rotating disc.

At the centre of the cylinder bore adjacent to the upper dead centres, UDC, of the pistons and at opposite sides thereof there are two valves 50, 51. In the embodiment shown in the figures these valves are outlet valves. The valves each have a head 52, 53 and a shaft 54, 55. In the cylinder there are corresponding valve seats and the shafts are designed with consideration of the through passages and stearings which are arranged in the stationary parts adjacent to the cylinder. According to the invention, the valve shafts, at the ends thereof opposite the heads contact a controlling curve or surface 56 which is a,part of the rotating disc. On the control curve there are raised parts 57, 58 which cause the valves to open when disc 13 rotates. The returning of the valves can be made in known ways by means of valve springs which are not shown in the figures.

Figure 5:
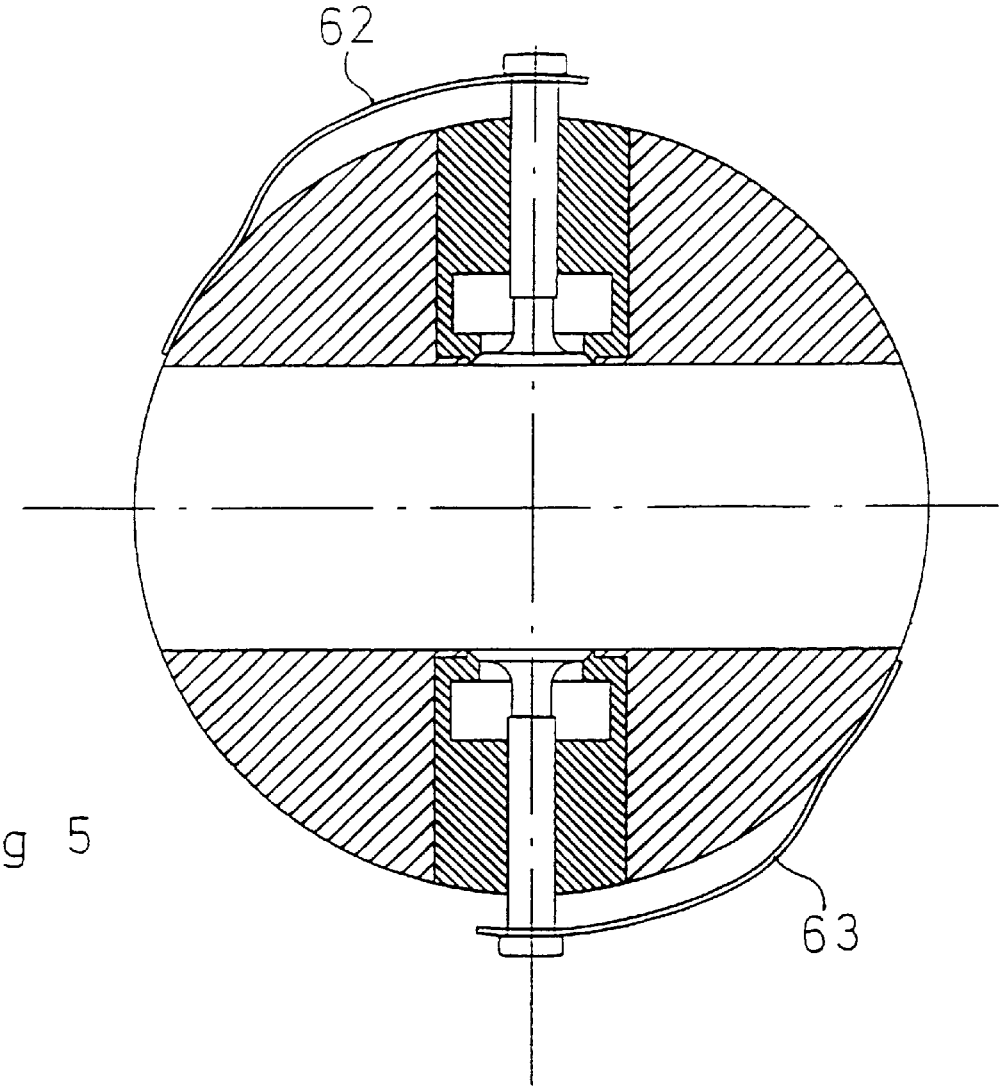
Figure 6:
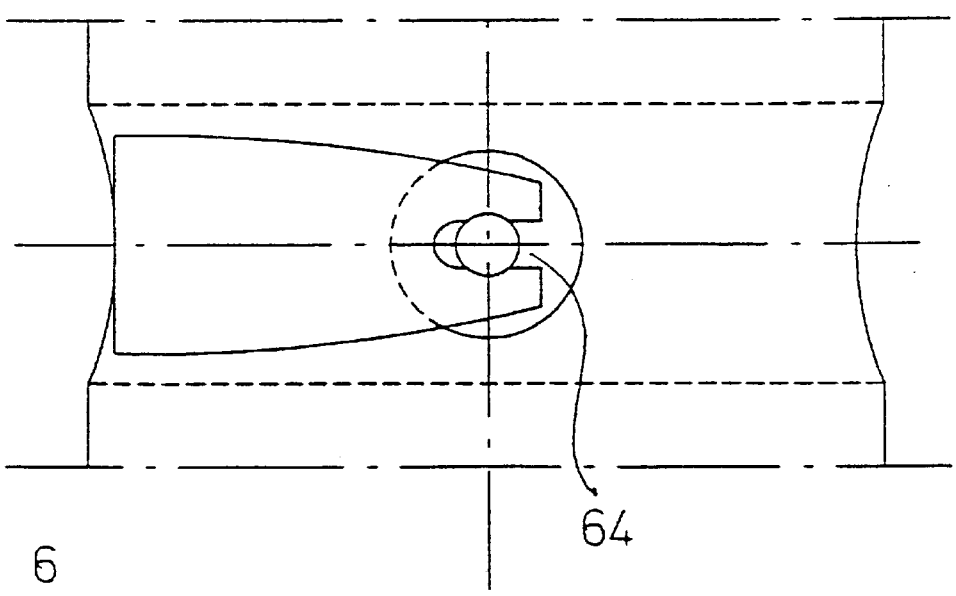

In other embodiments which are shown in FIGS. 3–6 the valve springs are made as blade springs 60, 61, 62, 63. The valve springs may then as in the embodiment of FIGS. 3 and 4 extend themselves outwards-inwards at both sides of the valve shaft, and be kept in position by a faster thereon. The outer ends of the valves then contact their supporting surfaces without any other fastening means. FIGS. 5 and 6 show an embodiment by which the valve spring is mounted onto the cylinder housing and engages with the valveshaft by a track 64 in the spring allowing a displacement of the surface of contact between the spring and the valve shaft.

In a further embodiment of the invention the valve movements are controlled in both directions by camcurves whereby the valve springs can be eliminated. In other embodiments of the invention the valve heads and valve seats may be displaced towards the centre of the cylinder thereby that the valve seats are built up from the inner wall of the cylinder. The device will then be designed so that there is enough space between the upper surfaces of the pistons when the pistons are in their UDC. This makes it possible to displace the valve mechanism in its entirety towards the centre and thus reduce the diameter of the camcurve 56.

In other embodiments both the inlet and outlet valves may be arranged in the way which has been described above. The valve shafts of the two kinds of valves then contact camcurves which are adjacent to each other and having somewhat different shape. For this reason the valves are somewhat differently inclined relative to the horizontal plane of FIG. 1 and the difference in inclination between the two kinds of valves is preferably 5–10°. When the movement of the pistons, as described above, controls or is controlled by an elliptic track 12 in the rotating disc there are two piston strokes for each round that the disc rotates. In the corresponding way each valve is controlled by an essentially circular surface at the rotating disc, at which surface there are extensions which open the valve once for each round that the disc rotates. Inlet and outlet valves are effected by different circular surfaces whereby the respective extensions are displaced so that the valves open at the desired moments. The arrangement of conventional engine designs which require a camshaft which by a reduction is driven by a crankshaft can in this way be entirely eliminated.

Also embodiments having only one valve in the cylinder bore are possible within the frame of the inventive idea. Preferably this valve is an outlet valve and inlet is through ports, possibly in combination with a forgoing comprimation.

The valve heads 52, 53 are shown in the figures having a circular shape in the surface of the cylinder bore or a corresponding plane. In other embodiments the valveheads may be of elliptic shape in order to better make use of the surface of the cylinder bore which is available when the pistons at the same time are in their upper dead centre, UDC. The valveheads also have a preferably bent surface which follows the shape of the cylinder bore. The shape of the valveheads can also be so designed that they cooperate in controlling the gas flow inside the cylinder and possibly also its inlet and outlet channels.

I claim:

1. A power machine comprising:

a common cylinder having a bore formed therein;

two pistons disposed in said bore in opposed facing relation with respect to each other and being constructed and arranged to synchronously reciprocate within said bore in opposite respective directions so that said two pistons reach their respective top dead center and bottom dead center positions at about the same time, wherein said cylinder has formed therein transverse openings communicating with said bore adjacent said top dead center positions of said two pistons;

a transmission mechanism for converting linear reciprocating movement of said two pistons into a rotating movement, said transmission mechanism comprising a rotating disc and a stationary disc, said rotating and stationary discs being operatively coupled to each other and to said two pistons to convert reciprocating movement of said pistons into rotation of said rotating disc;

a valve associated with each of said transverse openings, each said valve comprising a valve shaft and a valve head disposed at one longitudinal end of said valve shaft; and a controlling surface connected to said rotating disk and positioned to engage a longitudinal end of said valve shaft opposite said valve head of each said valve during at least a portion of each rotation of said rotating disk to thereby control movement of each said valve relative to its associated transverse opening during rotation of said rotating disk.

2. The power machine of claim 1, wherein said controlling surface comprises a marginal surface of a central opening formed in said rotating disk.

3. The power machine of claims 1 or 2, wherein said two pistons have a common combustion chamber within said bore.

4. The power machine of claims 1 or 2, wherein an extension of an axis of rotation of said rotating disk coincides with the longitudinal center of said bore between said two pistons.

5. The power machine of claim 3, wherein an extension of an axis of rotation of said rotating disk coincides with the longitudinal center of said bore between said two pistons.

6. The power machine of claims 1 or 2, wherein said transverse openings of said cylinder comprise outlets and said valves comprise outlet valves.

7. The power machine of claim 3, wherein said transverse openings of said cylinder comprise outlets and said valves comprise outlet valves.

8. The power machine of claim 4, wherein said transverse openings of said cylinder comprise outlets and said valves comprise outlet valves.

9. The power machine of claim 5, wherein said transverse openings of said cylinder comprise outlets and said valves comprise outlet valves.

* * * * *